US008308194B2

(12) United States Patent
Wilen

(10) Patent No.: US 8,308,194 B2
(45) **Date of Patent: *Nov. 13, 2012**

(54) FOLDING BOOKLET

(76) Inventor: Richard Wilen, Coral Springs, FL (US)

( * ) Notice: Subject to any disclaimer, the term of this patent is extended or adjusted under 35 U.S.C. 154(b) by 496 days.

This patent is subject to a terminal disclaimer.

(21) Appl. No.: 10/873,317

(22) Filed: Jun. 21, 2004

(65) Prior Publication Data

US 2005/0023819 A1 Feb. 3, 2005

Related U.S. Application Data

(63) Continuation-in-part of application No. 09/454,117, filed on Dec. 3, 1999, now abandoned.

(51) Int. Cl.
*B42D 15/00* (2006.01)

(52) U.S. Cl. ..... 281/38; 235/380; 281/40; 281/3.1; 283/64

(58) Field of Classification Search ..... 281/2, 3.1, 281/5, 29, 34, 23, 31, 36–38, 40; 283/34, 283/61, 63.1, 64; 428/68, 76, 7; 235/380
See application file for complete search history.

(56) References Cited

U.S. PATENT DOCUMENTS

| | | | | | |
|---|---|---|---|---|---|
| 512,882 | A | * | 1/1894 | Hillhouse | 283/34 |
| 867,613 | A | * | 10/1907 | Scragg | 229/92.8 |
| 1,161,580 | A | * | 11/1915 | Allen | 40/530 |
| 1,306,691 | A | * | 6/1919 | Goetz | 281/29 |
| 2,138,443 | A | * | 11/1938 | Cavalero | 281/31 |
| 2,507,615 | A | * | 5/1950 | Sharp, Jr. | 283/34 |
| 3,211,470 | A | * | 10/1965 | Wilson | 283/85 |
| 3,399,473 | A | * | 9/1968 | Jaffe | 283/83 |
| 3,534,358 | A | * | 10/1970 | Stern | 340/572.1 |
| 3,738,686 | A | * | 6/1973 | Morse | 283/63.1 |
| 4,200,945 | A | * | 5/1980 | Ellis | 412/4 |
| 4,270,773 | A | * | 6/1981 | Gaetano | 283/34 |
| 4,394,038 | A | * | 7/1983 | Klein | 462/55 |
| 4,906,024 | A | * | 3/1990 | Lein | 281/5 |
| 5,029,902 | A | * | 7/1991 | Komori | 283/56 |
| 5,040,216 | A | * | 8/1991 | Policht | 281/46 |
| 5,104,146 | A | * | 4/1992 | Schulz et al. | 281/15.1 |
| 5,137,304 | A | * | 8/1992 | Silverschotz et al. | 283/100 |
| 5,156,898 | A | * | 10/1992 | McDonald | 428/100 |
| 5,290,066 | A | * | 3/1994 | Mody | 281/15.1 |
| 5,294,208 | A | * | 3/1994 | Tremmel et al. | 402/70 |
| 5,358,761 | A | * | 10/1994 | McDonald | 428/77 |
| 5,369,571 | A | * | 11/1994 | Metts | 705/7.33 |
| 5,489,120 | A | * | 2/1996 | Thornsburg | 281/33 |

(Continued)

FOREIGN PATENT DOCUMENTS

CA 01320233 * 7/1993

(Continued)

*Primary Examiner* — Boyer D Ashley
*Assistant Examiner* — Sara Addisu
(74) *Attorney, Agent, or Firm* — Johnson & Martin, P.A.; James David Johnson

(57) ABSTRACT

A folding booklet is disclosed having a booklet cover and one or more of booklet pages in which are formed a plurality of spaced apart longitudinal fold lines defining a plurality of longitudinal panels and a plurality of transverse fold lines defining a plurality of transverse panels. The longitudinal panels can be folded along the longitudinal fold lines to overlay one another and the transverse panels can be folded along the transverse fold lines to overlay one another. The cover can then be folded along a booklet cover fold line to completely contain the folded booklet pages.

12 Claims, 19 Drawing Sheets

U.S. PATENT DOCUMENTS 5,500,681 A * 3/1996 Jones ..... 348/473
5,612,527 A * 3/1997 Ovadia ..... 705/14.38
5,725,252 A * 3/1998 Crum et al. ..... 283/34
5,743,567 A * 4/1998 Warther ..... 283/61
5,857,705 A * 1/1999 Dahlquist ..... 281/5
5,882,763 A * 3/1999 Perttunen et al. ..... 428/99
5,918,905 A * 7/1999 Wilen ..... 281/16
5,989,033 A * 11/1999 Burgio ..... 434/88
6,000,724 A * 12/1999 Holway ..... 283/66.1
6,010,159 A * 1/2000 Warther ..... 283/61
6,045,160 A * 4/2000 Weeks ..... 281/29
6,410,114 B1 * 6/2002 McDonald ..... 428/64.1
6,588,658 B1 * 7/2003 Blank ..... 235/380
6,715,795 B2 * 4/2004 Klure ..... 283/62
6,752,427 B1 * 6/2004 Wilen ..... 281/38
6,824,066 B2 * 11/2004 Weyant ..... 235/493
7,219,829 B2 * 5/2007 Treat ..... 229/92.8
2002/0046089 A1 * 4/2002 Zorn ..... 705/14
2002/0088855 A1 * 7/2002 Hodes ..... 235/385
2003/0023482 A1 * 1/2003 Messner et al. ..... 705/14
2007/0152066 A1 * 7/2007 Colby et al. ..... 235/487

FOREIGN PATENT DOCUMENTS

CN 201338438 Y * 11/2009
EP 1013471 A1 * 6/2000

* cited by examiner

FOLDING BOOKLET

This application is a continuation-in-part of application Ser. No. 09/454,117 filed Dec. 3, 1999 now abandoned.

FIELD OF THE INVENTION

This invention is directed toward a folding booklet. More particularly, this invention is directed toward a folding booklet having a cover and a plurality of booklet pages, which can be folded to overlay one another in such a manner as to be completely contained within the cover. Even more particularly, the booklet pages are folded to fit within the cover without using accordion and/or concertina folds.

BACKGROUND OF THE INVENTION

It is well known to fold such items as maps, brochures, advertisements, business schedules, entertainment listings, general information, and the like into smaller units to facilitate storing, carrying and/or mailing them.

For example, U.S. Pat. No. 1,697,350 to Eubank discloses a map folded into zig-zag increments to form map portions or segments that can be turned like pages in a book.

U.S. Pat. No. 2,507,615 to Sharp, Jr. discloses a map folded in accordion or concertina fashion to a size enabling it to be placed in an envelope.

U.S. Pat. No. 3,738,686 to Morse discloses a plurality of leaves foldably joined together in the form of an elongated, accordion folded strip, which is attached to the spine of book-like covers. The leaves can be turned like pages in a book or be completely unfolded to provide a panoramic view of the subject matter displayed.

U.S. Pat. No. 4,270,773 to Gaetano discloses a map folded into a book-form and mounted between book covers. Folding of the map requires a minimum of four lateral folds and a minimum of seven longitudinal folds to provide a minimum of three double leaves with a central leaf which, when pulled out, creates an extended center fold.

U.S. Pat. No. 4,496,171 to Cherry discloses a TV program guide and advertising medium with sheets printed on both sides and multiple lateral fold lines to provide a magazine shaped article when the sheets are completely folded.

U.S. Pat. No. 4,583,763 to Shacklett, Jr. discloses a sheet having multiple longitudinal and horizontal, parallely spaced fold or score lines defining a plurality of rectangularly shaped panels which are folded in increasing overlapping relationship to form an information folder.

U.S. Pat. No. 4,606,553 to Nickerson discloses a printed map sheet having a plurality of longitudinal and horizontal fold lines defining a plurality of panels, one corner panel of which is secured to a cover. The sheet is first folded accordion style to form an elongated strip which, in turn, is folded accordion style to fit within a match book type cover.

U.S. Pat. No. 4,906,024 to Lein discloses a foldable sheet having a plurality of longitudinal and horizontal fold lines defining a plurality of panels, which are folded over one another in an interlocking arrangement.

U.S. Pat. No. 5,029,902 to Kosmori discloses a combined map and information brochure, one side edge of the map being secured to the spine of a brochure. The map is accordion folded to fit within the covers of the brochure.

U.S. Pat. No. 5,156,898 to McDonald, et.al. discloses a sheet having a plurality of longitudinal and horizontal fold lines defining a plurality of segments. Two of the segments at diagonally opposed corners are stiff portions. The sheet is folded accordion or concertina style first along the longitudinal fold lines then along the horizontal fold lines to provide a folded sheet contained between the stiff portions.

U.S. Pat. No. 5,358,761 to McDonald, et.al. discloses a sheet having a plurality of longitudinal and horizontal fold lines defining a plurality of segments. Two of the segments at diagonally opposed corners are stiff portions, one of the stiff portions having an extending edge area. When the sheet is folded accordion or concertina style first along the longitudinal fold lines then along the horizontal fold lines, the folded sheet is contained between the stiff portions with the extending edge area protruding beyond the folded sheet so that the folded article can be placed in a binder.

U.S. Pat. No. 5,393,021 to McDonald discloses a sheet having a plurality of longitudinal and horizontal fold lines defining a plurality of segments. Two of the segments at diagonally opposed corners are stiff portions, which are larger than the remaining segments. When the sheet is folded accordion or concertina style first along the longitudinal folds then along the horizontal folds, the folded sheet is contained between the enlarged stiff portions, which enable them to be grasped with opposite hands and unfold the folded sheet in a single movement.

U.S. Pat. No. 5,857,705 to Dahlquist discloses a multiweb, perforated folded product or magazine insert having a plurality of webs which can be roll folded, Z-folded, accordion folded, fan folded, plow folded or combinations of these fold to fit within a magazine.

U.S. Pat. No. 5,882,763 to Perttuman, et.al. discloses article having two sets of fold lines so that the article is first folded concertina style along a first set of fold lines and then folded concertina style along a second set of fold lines transverse to the first set of fold lines.

U.S. Pat. No. 5,918,905 to Wilen discloses a plurality of booklets-interconnected end to end to form a TV guide book strip, the pages of which are provided with horizontal perforations so that the top and bottom of each page can be separated from one another.

As can be seen, the foregoing patents employ a series of folding techniques that are cumbersome and generally include at least one series of accordion or concertina folds. When paper is subjected to accordion or concertina folding, it has a tendency to retain the memory of its fold. Consequently, when such paper is unfolded, it attempts to spring back to its folded condition making it unwieldy to handle and difficult to access the information that may printed on it.

SUMMARY OF THE INVENTION

It has now been found that the shortcomings associated with previous attempts to provide a sheet or a plurality of sheets of paper that can be readily folded and easily unfolded by a user and also be compactly contained in a suitable cover are overcome by the folding booklet of this invention.

In general, the folding booklet of the invention comprises: an outer booklet cover having opposed top and bottom edges, opposed side edges, a longitudinal fold line intermediate said side edges defining a panel on each side of said longitudinal fold line; and, a plurality of booklet pages secured to at least one of said panels of said booklet cover, said booklet pages having opposed top and bottom edges, opposed side edges, a plurality of spaced apart longitudinal fold lines formed in said booklet pages intermediate said side edges, one of said longitudinal fold lines being coincidental to and co-extensive with the longitudinal fold line of said booklet cover, said longitudinal fold lines defining a plurality of longitudinal panels, said booklet pages further having a plurality of spaced apart horizontal fold lines formed therein intermediate said top and bottom edges defining a plurality of horizontal panels, the uppermost of said horizontal panels overlying and being co-extensive with said cover, such that said longitudinal panels can be folded along said longitudinal fold lines to overlay one another and said horizontal panels can be folded along said horizontal fold lines to overlay one another and collectively overlay said uppermost horizontal panel enabling said booklet cover to be folded closed along said longitudinal fold line of said booklet cover with said folded and overlaying longitudinal panels and said folded and overlaying horizontal panels contained within said booklet cover.

In one embodiment, a magnetic strip can be provided on the booklet cover such as adjacent a side edge of one of the panels of the booklet cover and be encoded with desired information such as the combination for a hotel door lock, a user's credit card account number, a scanable bar code, and the like or it can be a memory chip.

In another embodiment, one of the panels of the booklet cover can be provided with a pocket which can be used to hold a hotel card key, foldable currency, a driver's license or other documents, merchandise information or warranties, advertisements, and the like.

In a further embodiment, a tab extension can be provided at a side edge of a booklet cover panel and can be imprinted with merchandise information, advertisements, and the like, and can also include a magnetic strip. The tab extension can alternatively be removably attached to the side edge of the booklet cover panel such as by providing a line of perforations at the point of attachment. If desired, a tab extension can be provided at the side edges of both of the booklet cover panels.

In still a further embodiment, two, foldable tab extensions can be provided at a side edge of a booklet cover and they can also contain printed matter, indicia, magnetic strips, bar codes, memory chips, and the like. When the tab extensions are folded to overlay one another, their combined thicknesses is about the same as or equal to that of a credit card or a hotel magnetic door key; i.e., about 30 points thick.

In yet another embodiment, one of the booklet cover panels can be dimensioned to be longitudinally longer than the other booklet cover panel so that the top and bottom edges of the longer panel extend beyond the top and bottom edges of the other panel.

In a further embodiment, the fold line of the booklet cover can be horizontally disposed intermediate the top and bottom edges of the booklet cover to define upper and lower panels in the booklet cover.

In still a further embodiment, an aperture can be formed in a corner of one of the booklet cover panels to facilitate attachment of the folding booklet to an item of merchandise.

In yet another embodiment, a cutout slot can be formed adjacent the top edge of one of the booklet cover panels to accommodate suspending the folding booklet on a display rod.

In still a further embodiment, one or more gates can be provided at the side edges of a booklet page or at the side edges of a plurality of booklet pages.

The booklet pages of the folding booklet can contain or be imprinted with any type of information desired. For example, the booklet pages can consist of one or more maps, general and local information, business and convention schedules and agendas, product warranties and descriptions or instructions, general and local news items, advertisements, and the like.

BRIEF DESCRIPTION OF THE DRAWING

The folding booklet of the invention is further illustrated in the accompanying drawing wherein.

DETAILED DESCRIPTION OF THE DRAWING AND THE INVENTION

Figure 1:
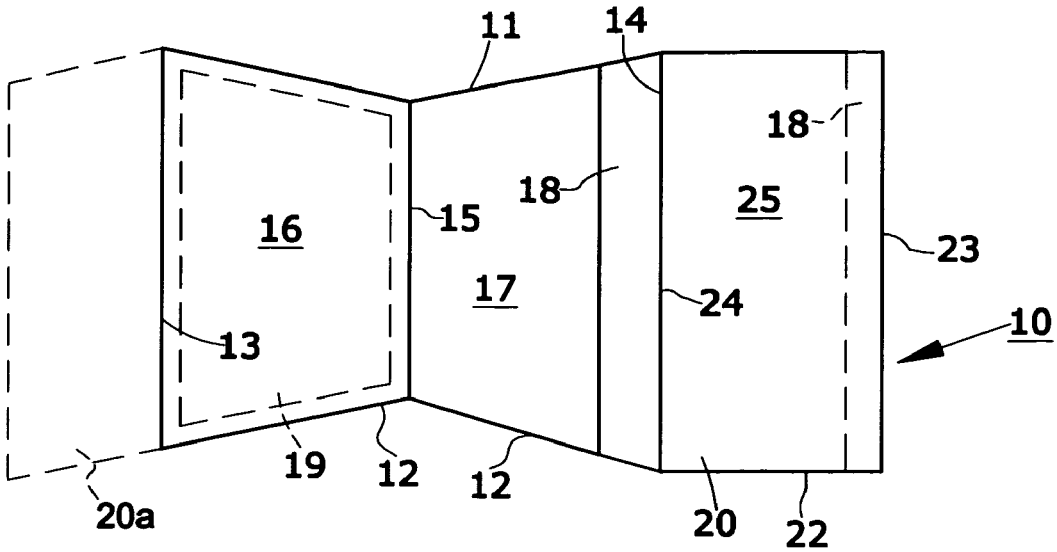
FIG. 1 is a perspective view of one embodiment of a booklet cover that can be used for the folding booklet of the invention.

The folding booklet of the invention will become more apparent from the ensuing discussion when considered together with the accompanying drawing wherein like reference numerals and letters denote like parts.

One embodiment of a booklet cover for the folding booklet of the invention is illustrated by FIG. 1 and is generally identified therein by reference numeral 10. Booklet cover 10 is generally rectangular and has opposed top and bottom edges 11 and 12, respectively, opposed side edges 13 and 14 and a longitudinal fold line 15 formed intermediate the opposed side edges defining panels 16 and 17. Although longitudinal fold line 15 can be located at any position intermediate side edges 13 and 14, it is preferably centered between side edges 13 and 14. Longitudinal fold line 15 serves as a hinge enabling the booklet cover 10 to be closed in the same manner as closing a book.

Booklet cover 10 can optionally be provided with a magnetic strip 18 positioned adjacent one of the side edges such as side edge 14 and can also be optionally provided with a pocket on one of the panels such as pocket 19 shown in phantom on panel 16. Magnetic strip 18 can be encoded with any desired information such as a hotel door lock code, a credit card account number, and the like. Pocket 19 can be made from any suitable material such as a clear, commercially available plastic and can be secured to the booklet cover panel by using conventional glues or heat sealing techniques.

A tab extension can also be secured to one of the side edges of the booklet cover such as tab extension 20 shown secured to side edge 14. Tab extension 20 has opposed top and bottom edges 21 and 22, respectively, which are preferably co-extensive with the top and bottom edges 11 and 12, respectively, of the booklet cover 10 and opposed side edges 23 and 24 defining a tab extension panel 25 therebetween. Side edge 24 of tab extension 20 is common with side edge 14 of booklet cover 10 defining a fold line so that tab extension 20 can folded into booklet cover 10 with tab extension panel 25 overlying booklet cover panel 17. Optionally, side edge 24 of tab extension 20 can be removably secured to the side edge 14 of booklet cover 10 such as with a perforation line. A magnetic strip can also be optionally provided adjacent one of the side edges of the tab extension such as magnetic strip 18 shown in phantom adjacent side edge 23. In addition, a tab extension can optionally be secured to the other side edge of the booklet cover such as tab extension 20*a* shown in phantom secured to side edge 13 of booklet cover 10.

Figure 2:
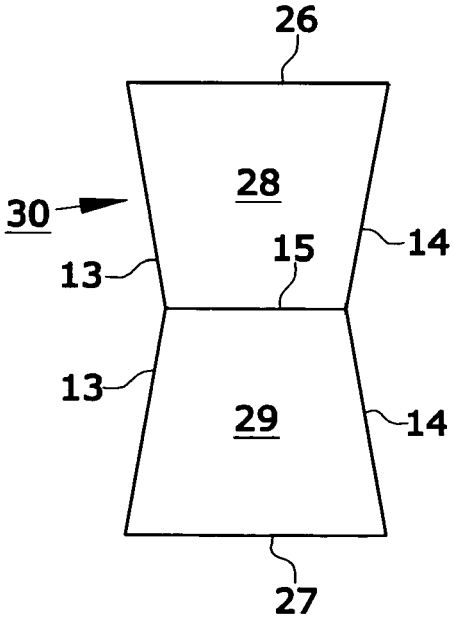
FIG. 2 is a perspective view illustrating another embodiment of a booklet cover that can be used for the folding booklet of the invention.

Another embodiment of a booklet cover of the invention is illustrated in FIG. 2. The booklet cover of this embodiment is substantially the same as that shown in FIG. 1 but rotated 90 degrees. The booklet cover in this embodiment is generally identified by reference numeral 30 and has opposed side edges 13 and 14, opposed top and bottom edges 26 and 27, respectively, and a horizontally disposed fold line 15 intermediate the top and bottom edges 26 and 27 defining panels 28 and 29. Preferably, fold line 15 is positioned centrally between the top and bottom edges 26 and 27 so that booklet cover 30 can be opened and closed in the same manner as a folio.

Figure 3:
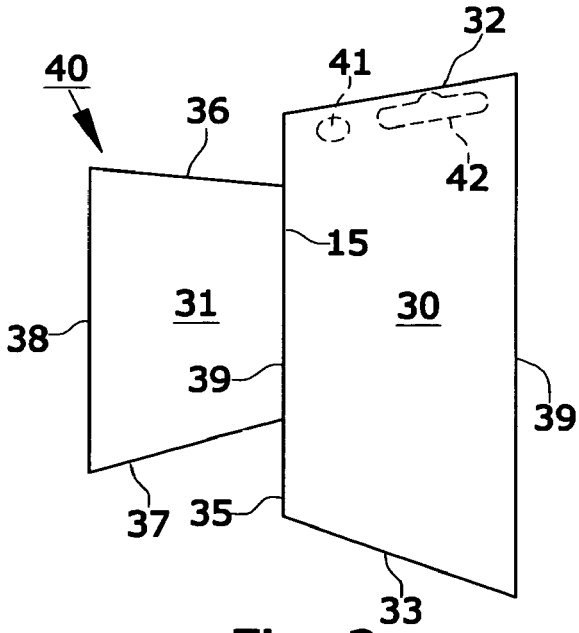
FIG. 3 is a perspective view illustrating a further embodiment of a booklet cover that can be used for the folding booklet of the invention.

FIG. 3 illustrates a further, embodiment of a booklet cover of the invention, the booklet cover being generally identified by reference numeral 40. In this embodiment, a common longitudinal fold line 15 joins panels 30 and 31. Panel 30 has opposed top and bottom edges 32 and 33, respectively, and opposed side edges 34 and 35, a portion of side edge 34 being common with longitudinal fold line 15. Panel 31 also has opposed top and bottom edges 36 and 37, respectively, and opposed side edges 38 and 39, side edge 39 being common with longitudinal fold line 15. As illustrated, panel 30 is formed to be longitudinally longer than panel 31 so that its top and bottom edges 32 and 33, respectively, extend beyond the horizontal plane of the top and bottom edges 36 and 37, respectively, of panel 31.

The booklet cover 40 shown in FIG. 3 also illustrates an aperture formed in a corner of one of the panels such as aperture 41 shown in phantom in the upper left hand corner of panel 30 to facilitate attaching the booklet cover using a string or a length of plastic to, for example, an item of merchandise. This embodiment also illustrates a cut-out slot formed adjacent a top edge such as cut-out slot 42 shown in phantom adjacent top edge 32 of panel 30 to accommodate suspending the booklet cover on a display rod.

While the aperture 41 and the cut-out slot 42 are shown with the booklet cover 40 illustrated in FIG. 3, they can also be readily provided in the booklet cover embodiments illustrated in FIGS. 1 and 2.

Figure 4:
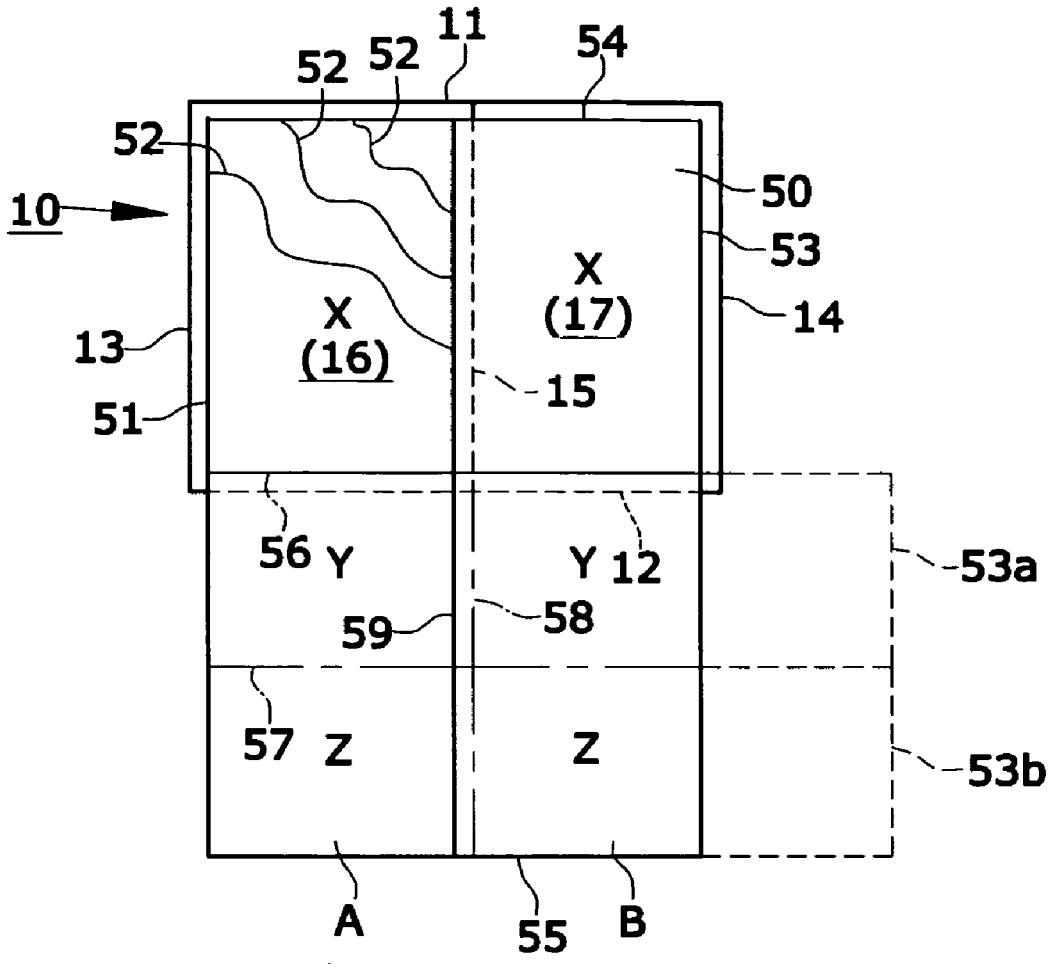
FIGS. 4-6 are plan views illustrating one embodiment of booklet pages secured to a booklet cover of a folding booklet of the invention and the sequence of folding the booklet pages so that they are completely contained within the booklet cover of the folding booklet.

FIG. 4 illustrates one embodiment of a booklet secured to a booklet cover of the invention. For purposes of illustration only, the booklet cover embodiment of FIG. 1 is shown.

In the embodiment of FIG. 4, a booklet, generally identified by reference numeral 50, is shown secured to both panels 16 and 17 of booklet cover 10. Booklet 50 has a plurality of booklet pages 52 bound together at booklet spine 51, which is also a side edge of the booklet 50. Spine 51 is secured to booklet cover 10 so that its edge is inboard of side edge 13 of the booklet cover 10. The other side edge 53 of booklet 50 is secured to booklet cover 10 so that it is inboard of side edge 14 of the booklet cover 10. Booklet 50 has a top edge 54 and a bottom edge 55, top edge 54 being positioned to be inboard of the top edge 11 of the booklet cover 10. Transverse fold lines, shown by long and short dash lines 56 and 57, are formed in booklet 50 intermediate the top and bottom edges 54 and 55, respectively, the uppermost transverse fold line 56 being formed so that it is inboard of the bottom edge 12 of the booklet cover 10. Transverse fold lines 56 and 57 define transverse panels X, Y and Z in booklet 50. Reference numeral 59 identifies the inner, common edges of pages 52 of the booklet 50 and reference numeral 58 identifies a longitudinal fold line shown in long-short dash lines that defines longitudinal panels A and B and which is co-extensive with longitudinal fold line 15 of the booklet cover 10/

One or more gates can also be provided at a side edge of booklet 50 as indicated in phantom at 53*a* and 53*b*. These gates 53*a* and 53*b* are extensions of the side edge 53 of booklet 50 and should preferably be of a size so that they are no greater in width than the transverse panels; for example, no greater in width than transverse panels Y and Z. When such gates are provided, they are preferably folded along the side edge to which they are attached; e.g., side edge 53, to overlay their respective transverse panels such as transverse panels Y and Z prior to folding the booklet. Gates such as gates 53*a* and 53*b* can be a fixed extension of a side edge of a booklet or they can be removably attached to a side edge of a booklet such as by using a perforation line.

Figure 5:
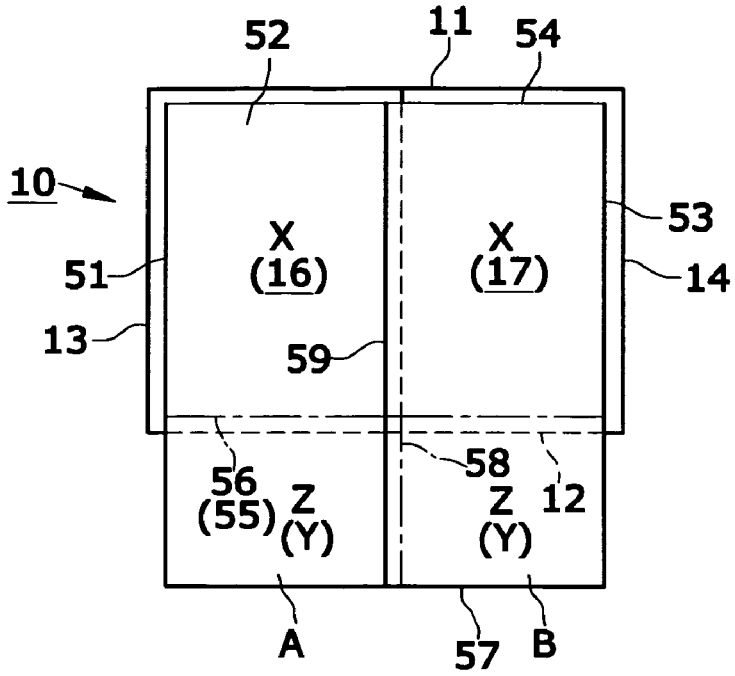
Figure 6:
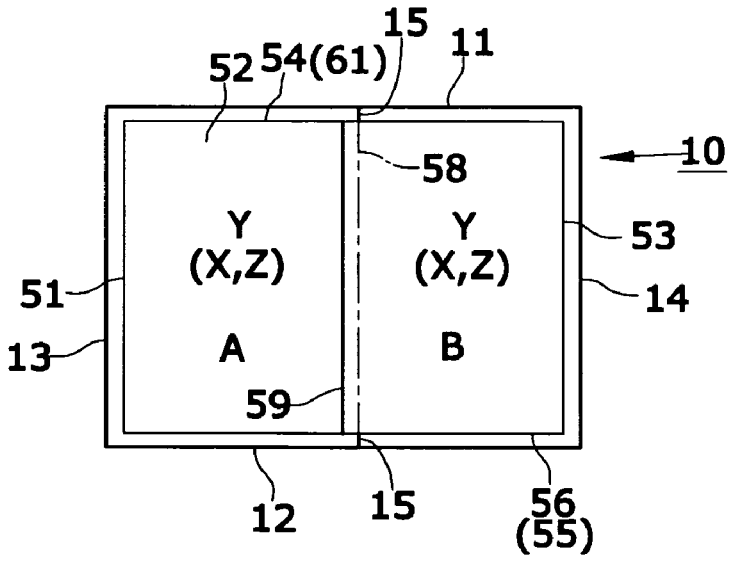

The sequence for folding the booklet 50 and the booklet pages 52 shown in FIG. 4 is illustrated in FIGS. 5 and 6. As shown in FIG. 5, transverse panel Z is folded along transverse fold line 57 so that transverse panel Z overlies transverse panel Y. These panels; i.e., transverse panels Z and Y, are then folded along transverse fold line 56 to overlie transverse panel X as shown in FIG. 6. Booklet cover 10 is now ready to be closed by folding it along longitudinal fold line 15 so that the entire booklet 50 is completely contained within booklet cover 10.

Figure 7:
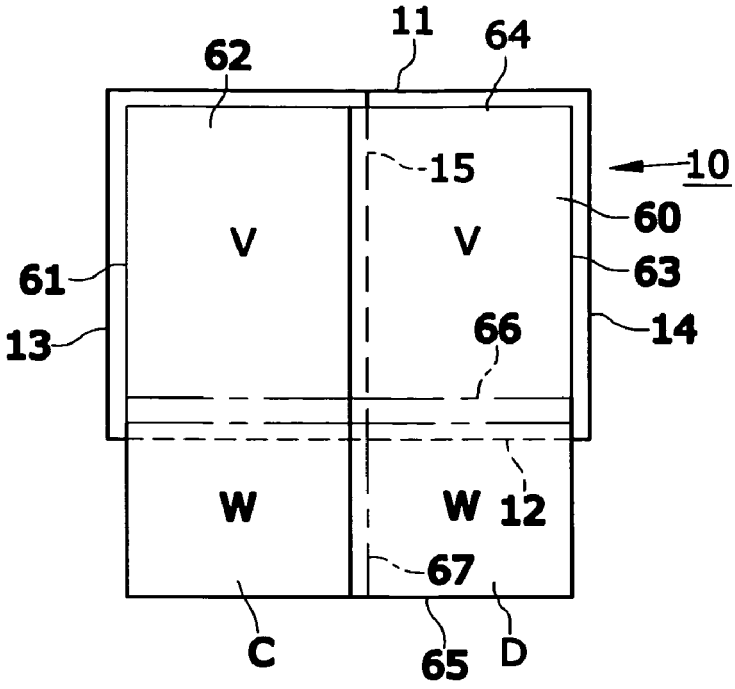
FIGS. 7 and 8 are plan views illustrating another sequence of folding booklet pages so that they are completely contained within the booklet cover of the folding booklet.

FIG. 7 illustrates a booklet 60 secured to a booklet cover such as the booklet cover 10 shown in FIG. 1. In this embodiment, booklet 60 consists of a plurality of booklet pages 62, which are bound together at booklet spine 61. Booklet 60 is secured to booklet cover 10 so that booklet spine 61 is positioned to be inboard of side edge 13 of booklet cover 10. Booklet spine 61 is one side edge of booklet 60 and its opposed side edge 63 is also positioned to be inboard of side edge 14 of booklet cover 10. Booklet 60 has opposed top and bottom edges 64 and 65, respectively, the top edge 64 being positioned to be inboard of the top edge 11 of booklet cover 10. A transverse fold line 66 is formed in booklet 60 inboard of the bottom edge 12 of the booklet cover 10 and defines transverse panels V and W. A longitudinal fold line 65 is also formed in booklet 60 to be substantially co-extensive with the longitudinal fold line 15 of the booklet cover 10, longitudinal fold line defining longitudinal panel C and D in the booklet 60.

Figure 8:
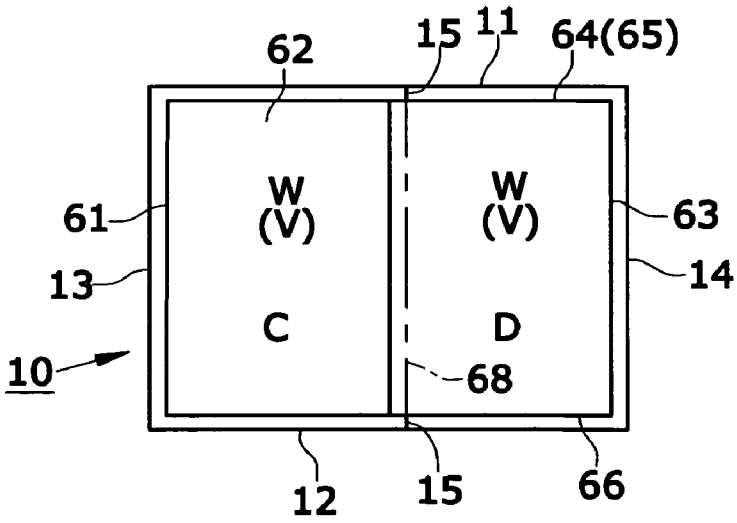

To fold the booklet 60, transverse panel W is folded along transverse fold line 66 so that transverse panel W overlies transverse panel V as shown in FIG. 8. At this time, transverse fold line 66 becomes the bottom edge of the booklet 60 and the former bottom edge 65 of the booklet 60 becomes substantially common with the top edge 64 of booklet 60. Booklet cover 10 can now be closed so that longitudinal panels C and D overlie one another with booklet 60 completely contained within booklet cover 10.

Figure 9:
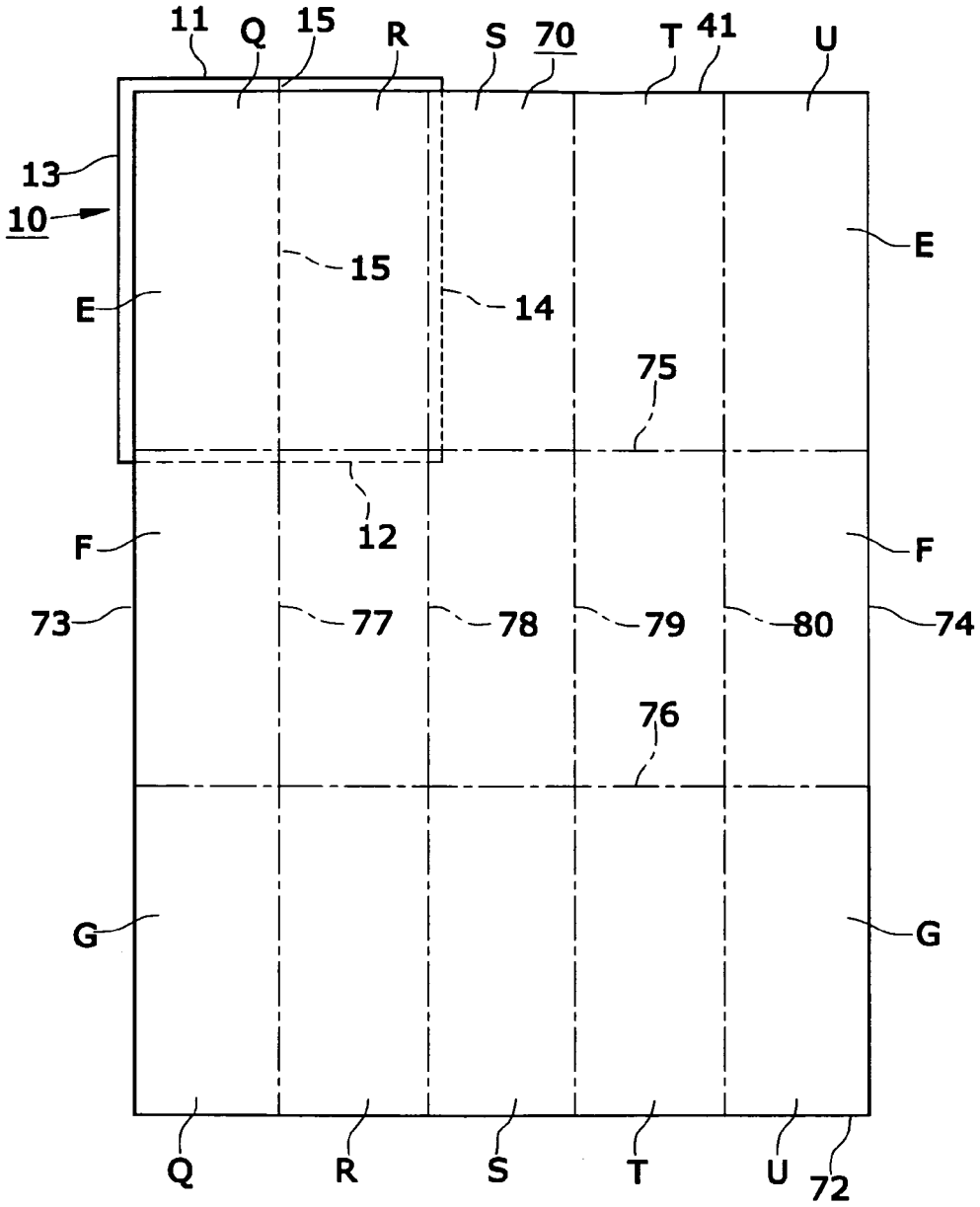
FIGS. 9-17 are plan views illustrating the manner in which a large booklet page such as a map can be secured to a booklet cover and a sequence for folding the large booklet page so that it is completely contained within the booklet cover.

FIG. 9 illustrates the manner in which a large booklet page such as a map can be secured to a booklet cover of the invention and FIGS. 10-14 illustrate a preferred sequence for folding the large booklet page.

With reference first to FIG. 9, one corner of a large booklet page, generally identified by reference numeral 70, is shown secured to a booklet cover of the invention such as booklet cover 10 illustrated in FIG. 1. Large booklet page 70 has opposed top and bottom edges 71 and 72, respectively, opposed side edges 73 and 74, transverse fold lines 75 and 76 formed in the booklet page 70 to define transverse panels E, F and G, and a plurality of longitudinal fold lines 77, 78, 79 and 80 formed in the booklet page 70 to define longitudinal panels Q, R, S, T and U. Side edge 73 of the booklet page 70 is positioned to be inboard of the side edge 13 of the booklet cover 10; top edge 71 of the booklet page 70 is positioned to be inboard of the top edge 11 of the booklet cover 10; the uppermost transverse fold line 75 of the booklet page 70 is positioned to be inboard of the bottom edge 12 of the booklet cover 10; the penultimate longitudinal fold line 78 is formed to be inboard of the side edge 14 of the booklet cover 10; and, the ultimate longitudinal fold line 77 is formed to be substantially co-extensive with longitudinal fold line 15 of the booklet cover 10.

Figure 10:
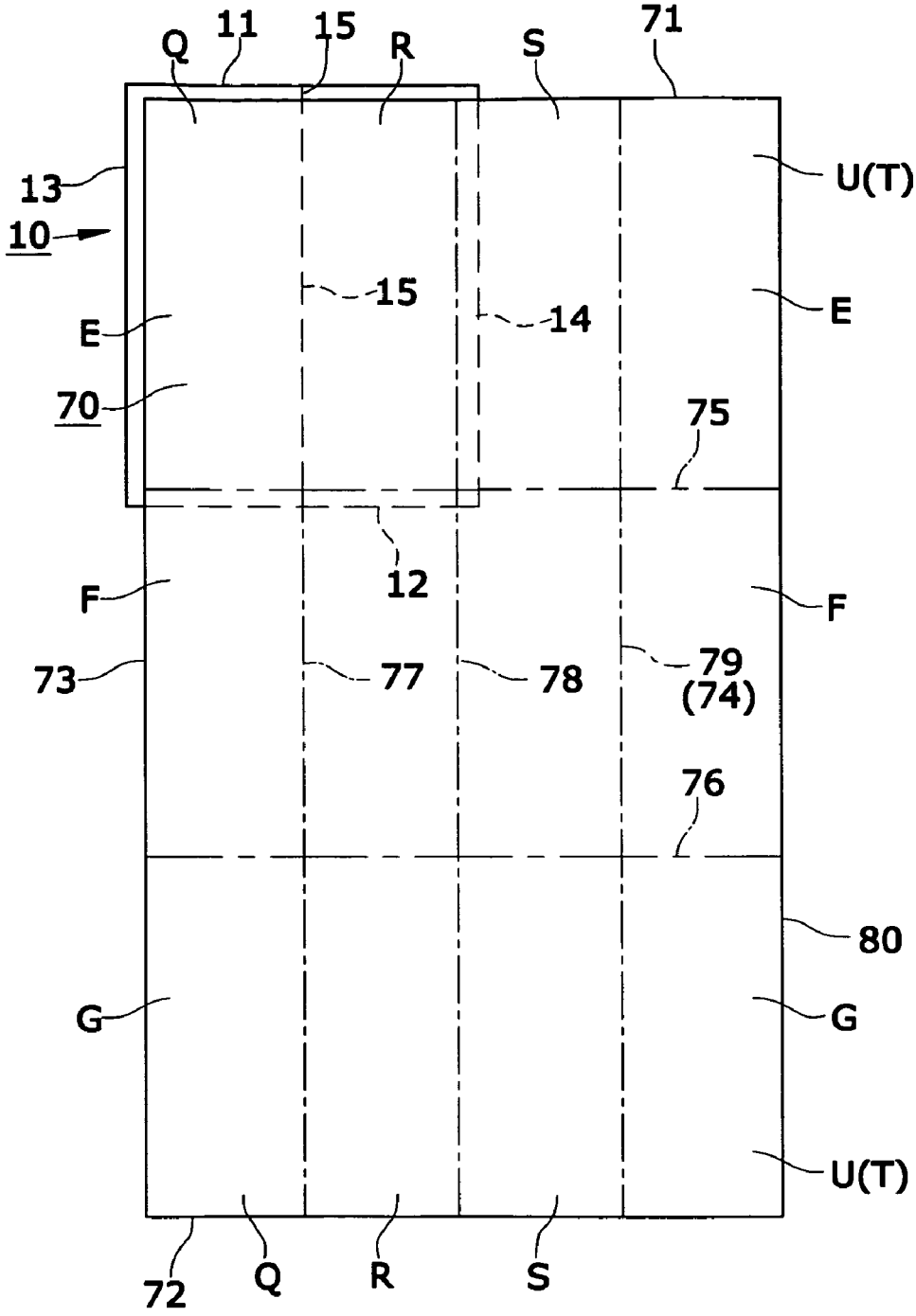
Figure 11:
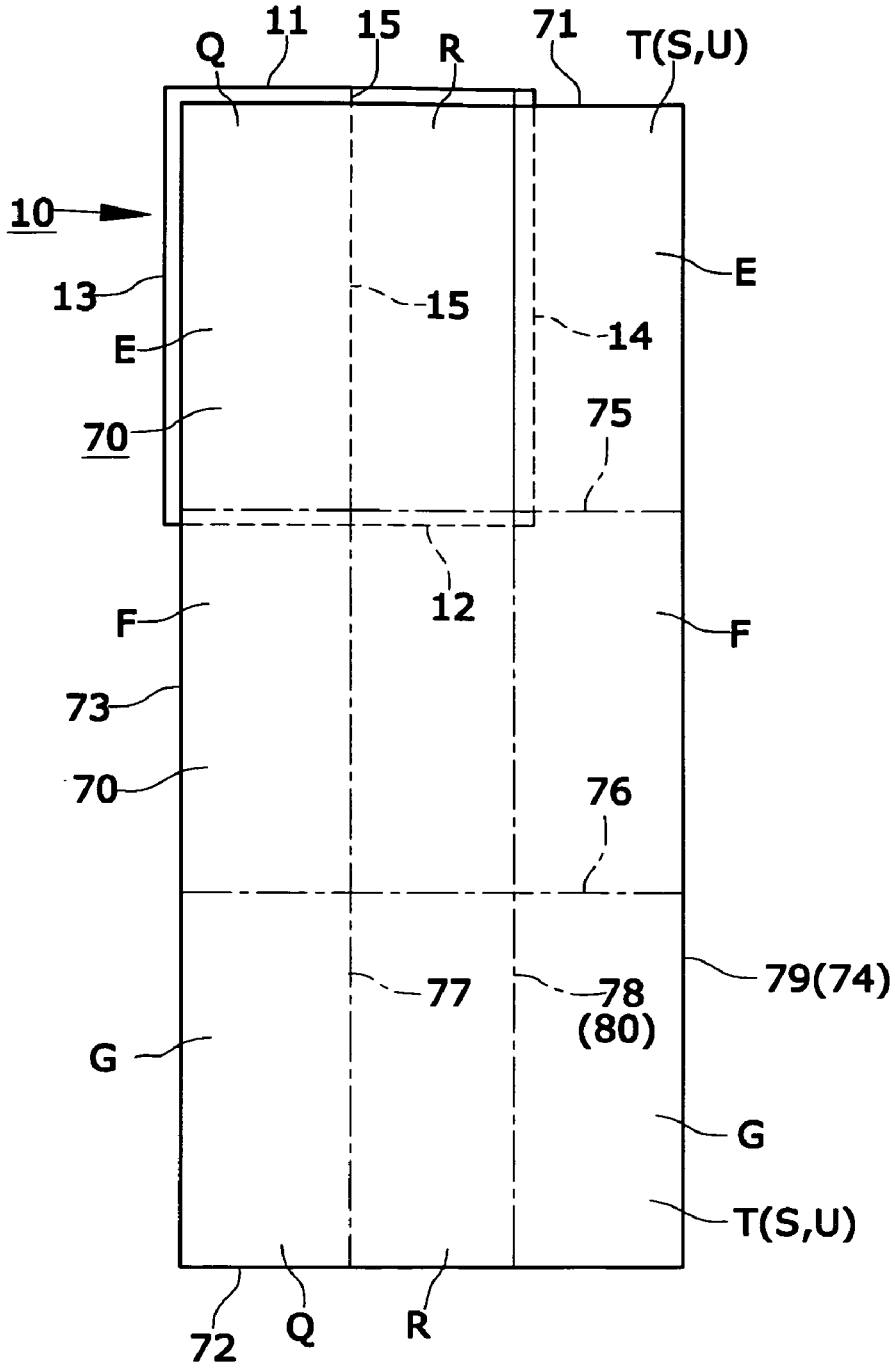
Figure 12:
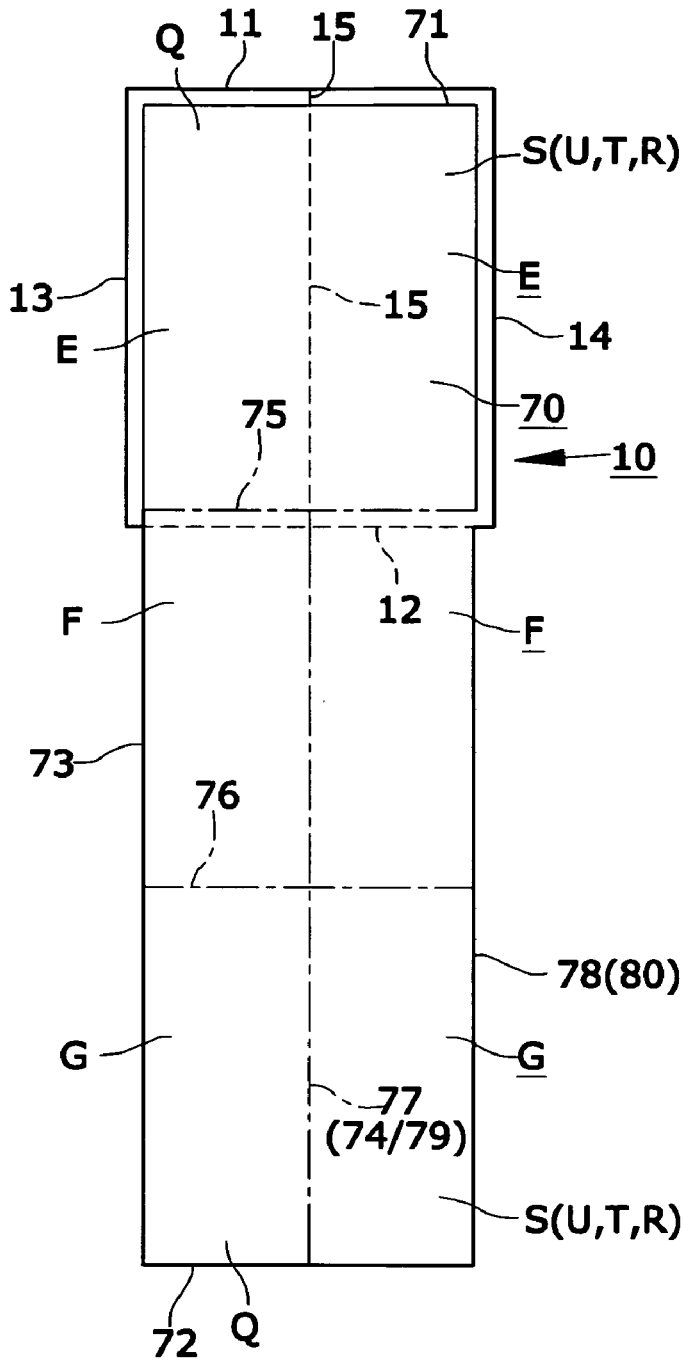
Figure 13:
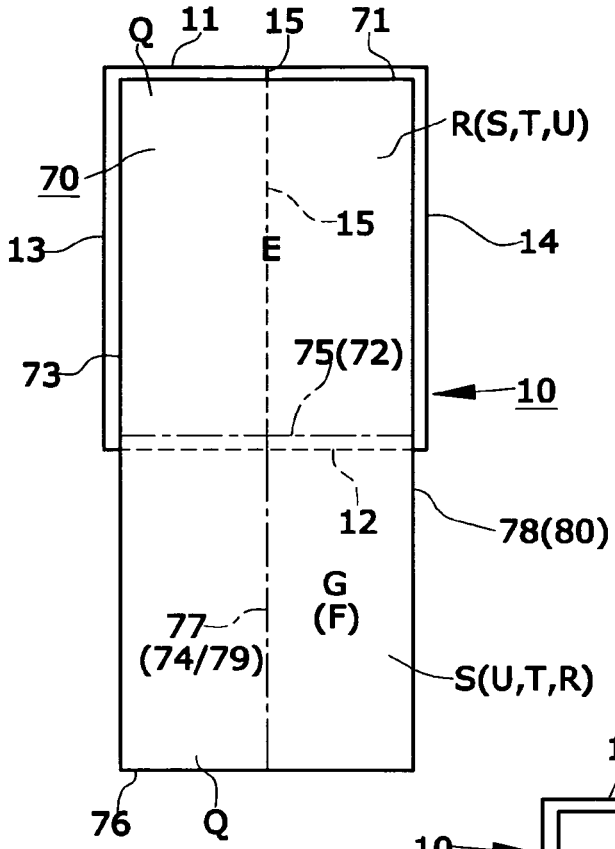
Figure 14:
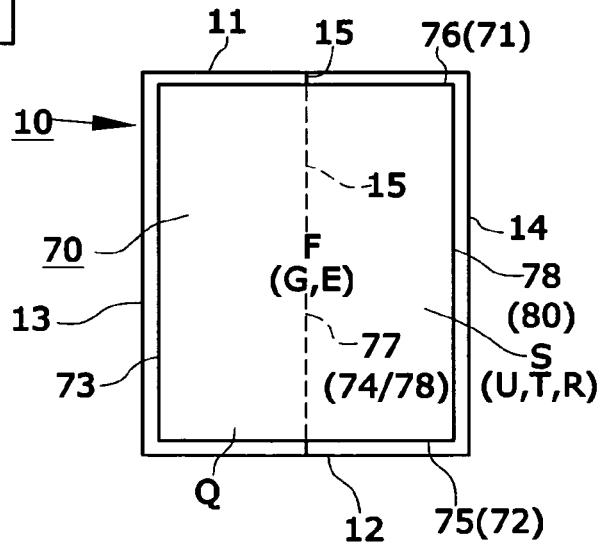

A preferred sequence for folding booklet page 70 is illustrated in FIGS. 10-14. As shown in FIG. 10, longitudinal panel U is first folded along longitudinal fold line 80 so that longitudinal panel U overlies longitudinal panel T and longitudinal fold line 80 becomes the side edge of booklet page 70. Longitudinal panels U/T are then folded along longitudinal fold line 79 so that longitudinal panel T overlies longitudinal panels S and U and longitudinal fold line 79 becomes the side edge of booklet page 70 as shown in FIG. 11. Next, longitudinal panels T, S and U are folded along longitudinal fold line 78 so that longitudinal panel S overlies longitudinal panels U, T and R and longitudinal fold line 78 becomes the side edge of booklet page 70 as shown in FIG. 12. Transverse panel G is then folded along transverse fold line 76 so that transverse panel G overlies transverse panel F and transverse fold line 76 becomes the bottom edge of the booklet page 70 as shown in FIG. 13. Transverse panels G/F are then folded along transverse fold line 75 to overlay transverse panel E so that transverse fold line becomes the bottom edge of booklet page 70 as shown in FIG. 14. At this time, booklet cover 10 can be closed by folding it along its longitudinal fold line 15 with all of the transverse and longitudinal panels of the booklet page 70 contained completely within the booklet cover 10.

Figure 15:
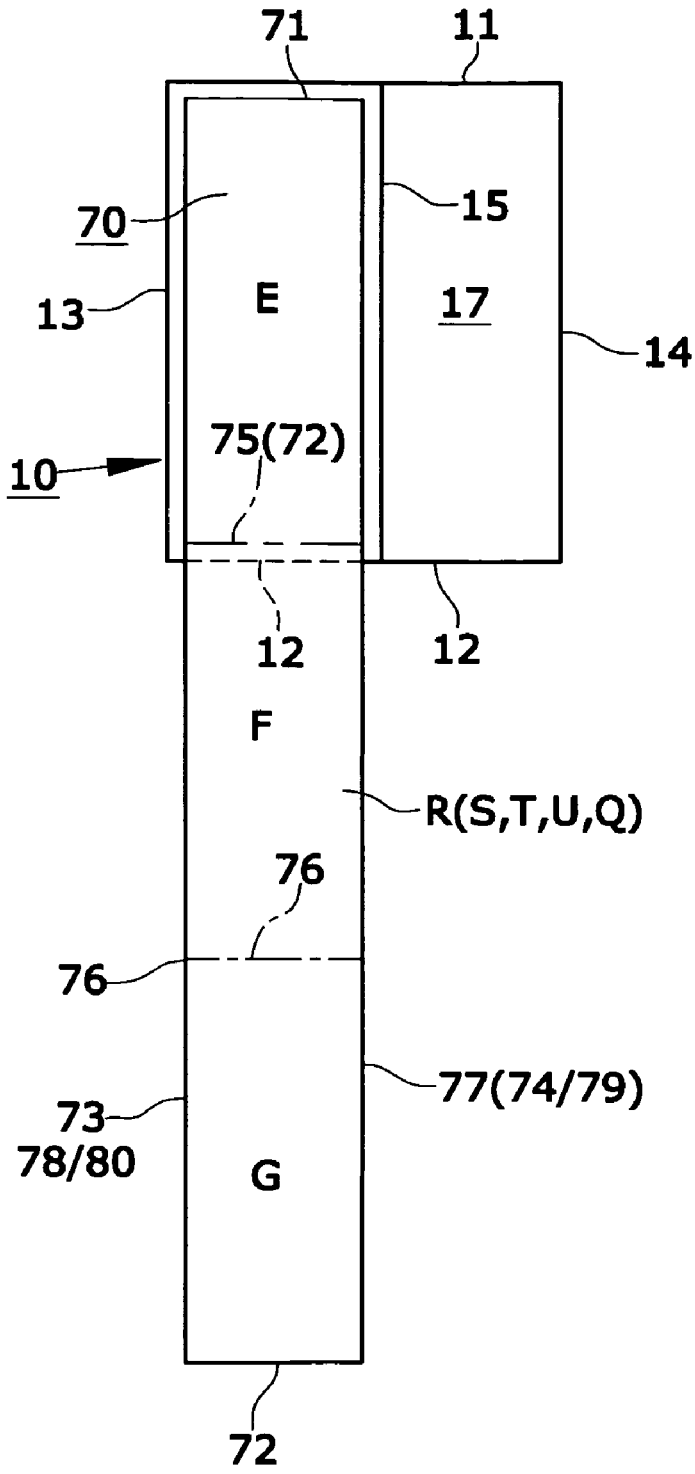
Figure 16:
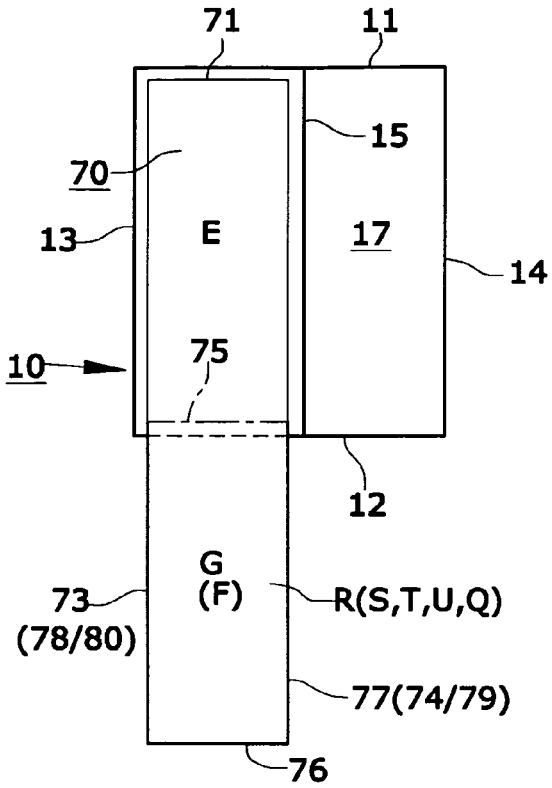
Figure 17:
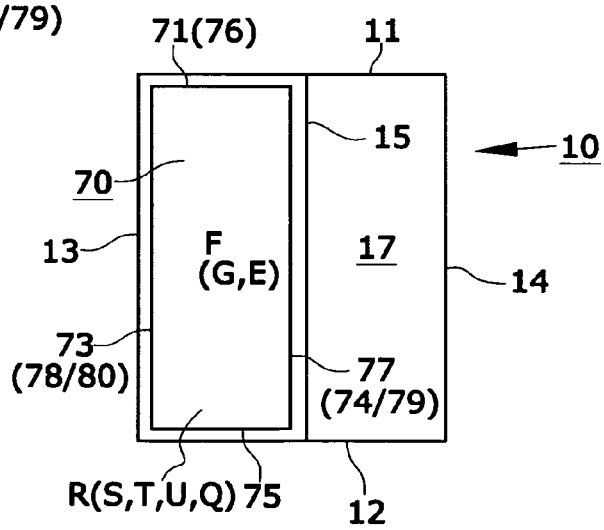

An alternative sequence for folding booklet page 70 is illustrated in FIGS. 12 and 15-17. With reference to FIG. 12 and as shown in FIG. 15, longitudinal panels S, U, T and R can folded along longitudinal fold line 77 so that longitudinal panel R overlies longitudinal panels S, T, U and Q and longitudinal fold line 77 becomes the side edge of booklet page 70. Transverse panel G is then folded along transverse fold line 76 to overlay transverse panel F with transverse fold line 76 becoming bottom edge of booklet page 70 as shown in FIG. 16. Transverse panels G/F are then folded along transverse fold line 75 to overlay transverse panel E with transverse fold line 75 becoming the bottom edge of booklet page 70 as shown in FIG. 17. Booklet cover 10 can now be closed by folding it along its longitudinal fold line 15 with all of the transverse and longitudinal panels of booklet page 70 contained completely within the booklet cover 10.

Figure 18:
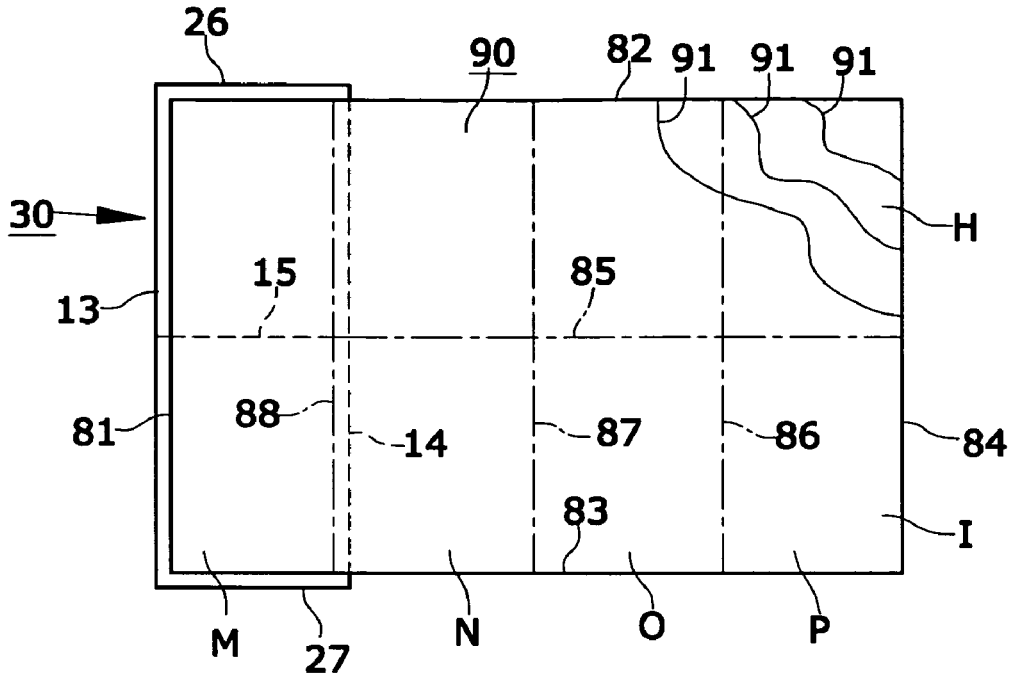
FIGS. 18-22 are plan views illustrating a booklet cover having a horizontally disposed fold line and the sequence of folding the booklet pages so that they are completely contained within the booklet cover.

FIG. 18 illustrates the use of the booklet cover embodiment shown in FIG. 2 having a horizontally or transversely disposed fold line. As shown in FIG. 18, a booklet, generally identified by reference numeral 90, having a plurality of booklet pages 91 which are bound together at spine 81 is secured to booklet cover 30 so that spine 81 is positioned to be inboard of side edge 13 of the booklet cover 13 and the top-edge 82 of booklet 90 is positioned to be inboard of the top edge 26 of the booklet cover 30. Reference numeral 83 identifies the bottom edge of the booklet 90 and reference numeral 84 identifies the other side edge of the booklet 30. Booklet 30 has a transverse fold line 85 formed in it so that it is substantially co-extensive with the transverse fold line 15 of the booklet cover 30 and defines transverse panels H and I. A plurality of longitudinal fold lines 86, 87 and 88 are also formed in booklet 90 defining longitudinal panels M, N, O and P with longitudinal fold line 88 being positioned to be inboard of side edge 14 of the booklet cover 30.

Figure 19:
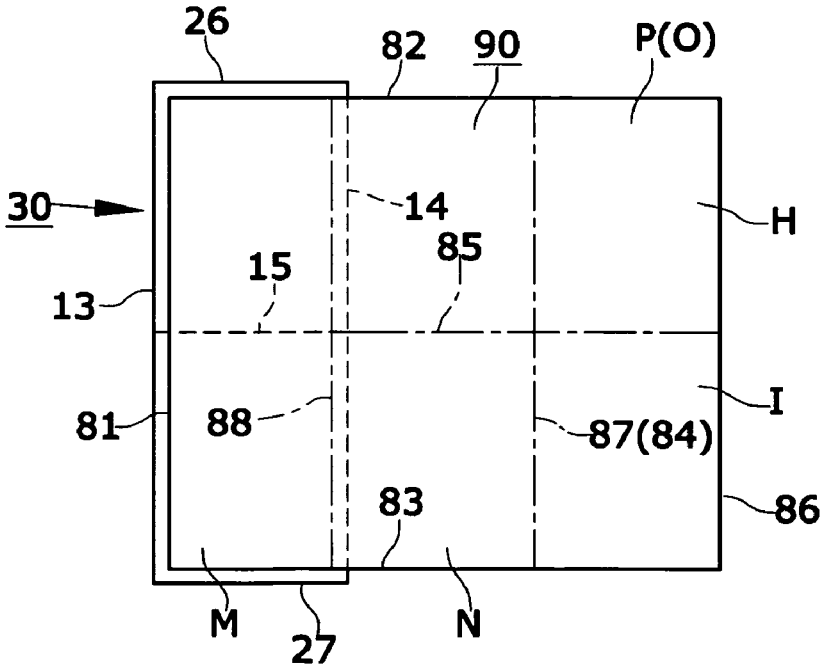
Figure 20:
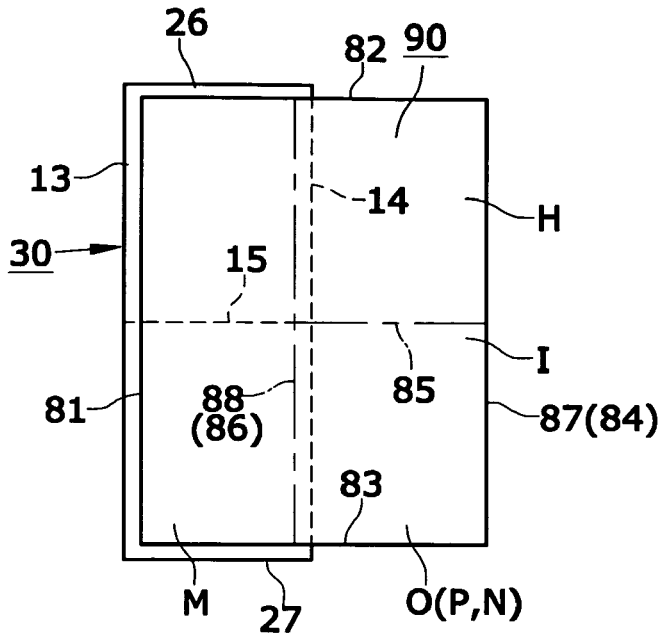
Figure 21:
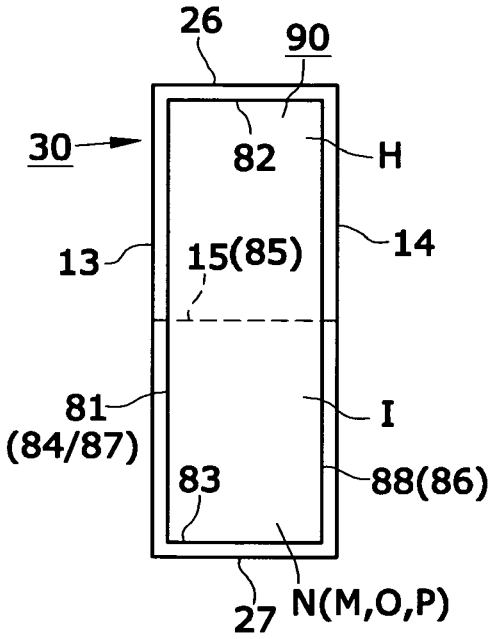
Figure 22:
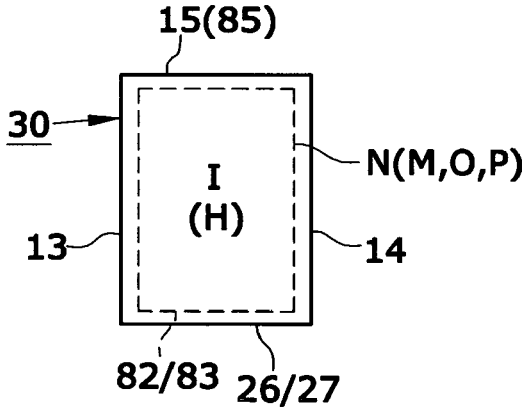

A sequence for folding the booklet 90 shown in FIG. 18 is illustrated in FIGS. 19-22. As can be seen in FIG. 19, longitudinal panel P is folded along longitudinal fold line 86 so that longitudinal panel P overlies longitudinal panel O with longitudinal fold line 86 becoming the side edge of booklet 90. Longitudinal panels P/O are then folded along longitudinal fold line 87 so that longitudinal panel O overlies longitudinal panels P and N and longitudinal fold 87 becomes the side edge of booklet 90 as shown in FIG. 20. Longitudinal panels O, P and N are then folded along longitudinal fold line 88 so that longitudinal panel N overlies longitudinal panels M, O and P and longitudinal fold line becomes the side edge of booklet 90 as shown in FIG. 21. Next, transverse panel I is folded along transverse fold line 85 to overlay transverse panel H so that transverse fold line 85 becomes common with the transverse fold line 15 of the booklet cover 30. Booklet cover 30 can then be closed folio fashion by folding it along its transverse fold line 15 with all of the longitudinal and transverse panels of the booklet 90 contained completely within the booklet cover 30 as shown in FIG. 22.

Figure 23:
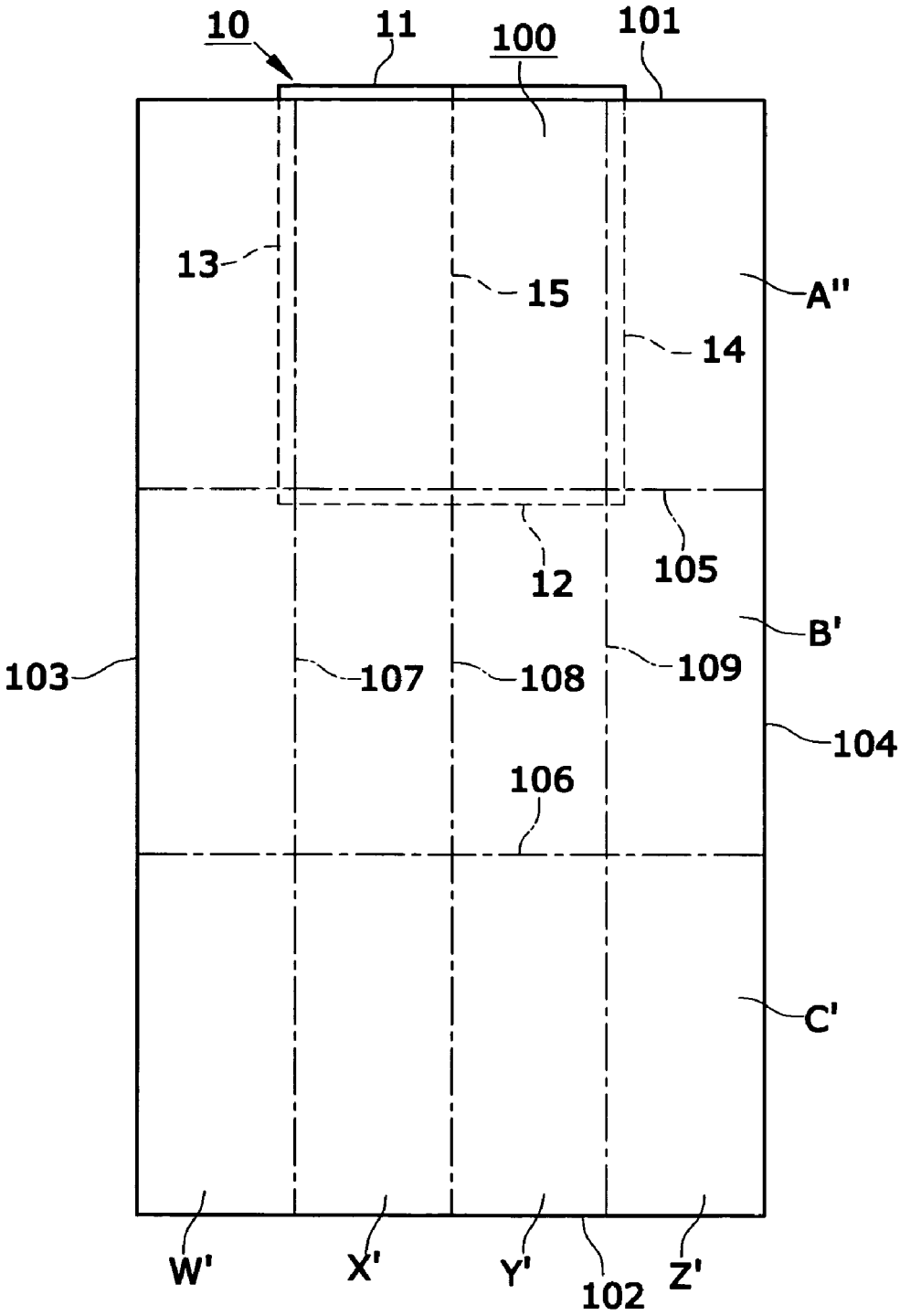
FIGS. 23-27 are plan views illustrating another embodiment of a booklet page or a plurality of booklet pages secured to a booklet cover and the manner of folding the booklet page or booklet pages to be completely contained within the booklet cover, and, FIGS. 28-30 are plan views illustrating still another embodiment of a booklet cover having two, foldable attached side tab extensions.

Another embodiment illustrating a booklet secured to a booklet cover of the invention is shown in FIG. 23. In this embodiment, the booklet cover used for purposes of illustration is the booklet cover shown in FIG. 1. As can be seen in FIG. 23, a booklet, generally identified by reference numeral 100, has opposed top and bottom edges 101 and 102, respectively; opposed side edge 103 and 104; a plurality of transverse fold lines 105 and 106 formed in the booklet 100 defining transverse panels A', B' and C'; and, a plurality of longitudinal fold lines 107, 108 and 109 formed in the booklet 100 defining longitudinal panels W', X', Y' and Z'. In this embodiment, booklet 100 is secured to cover 10 so that its top edge 101 is positioned to be inboard of the top edge 11 of the booklet cover 30; transverse fold line is formed to be inboard of the bottom edge 12 of the booklet cover 10; longitudinal fold line is formed to be inboard of side edge 13 of the booklet cover 10; and, longitudinal fold line 109 is formed to be inboard of side edge 14 of the booklet cover 10.

Figure 24:
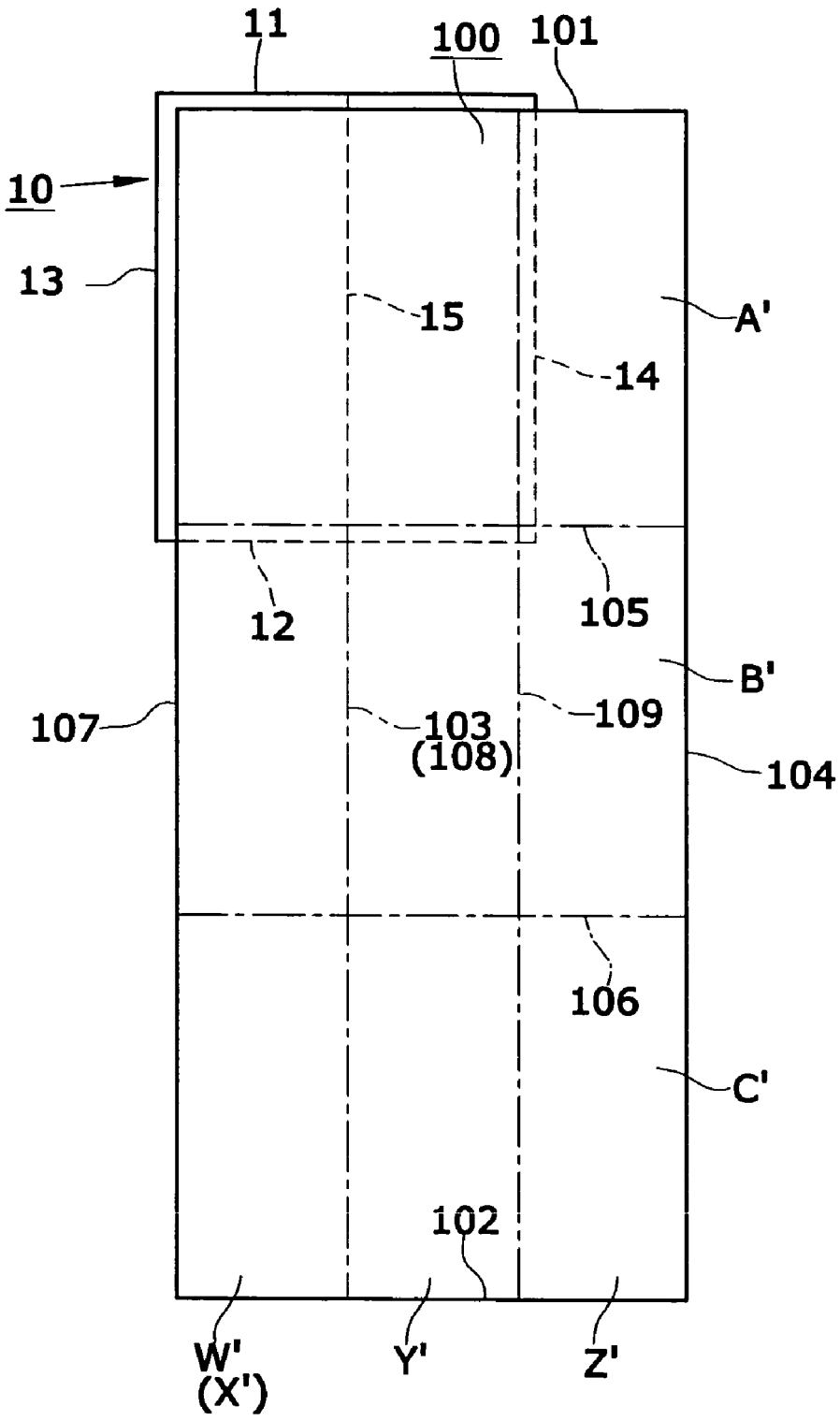
Figure 25:
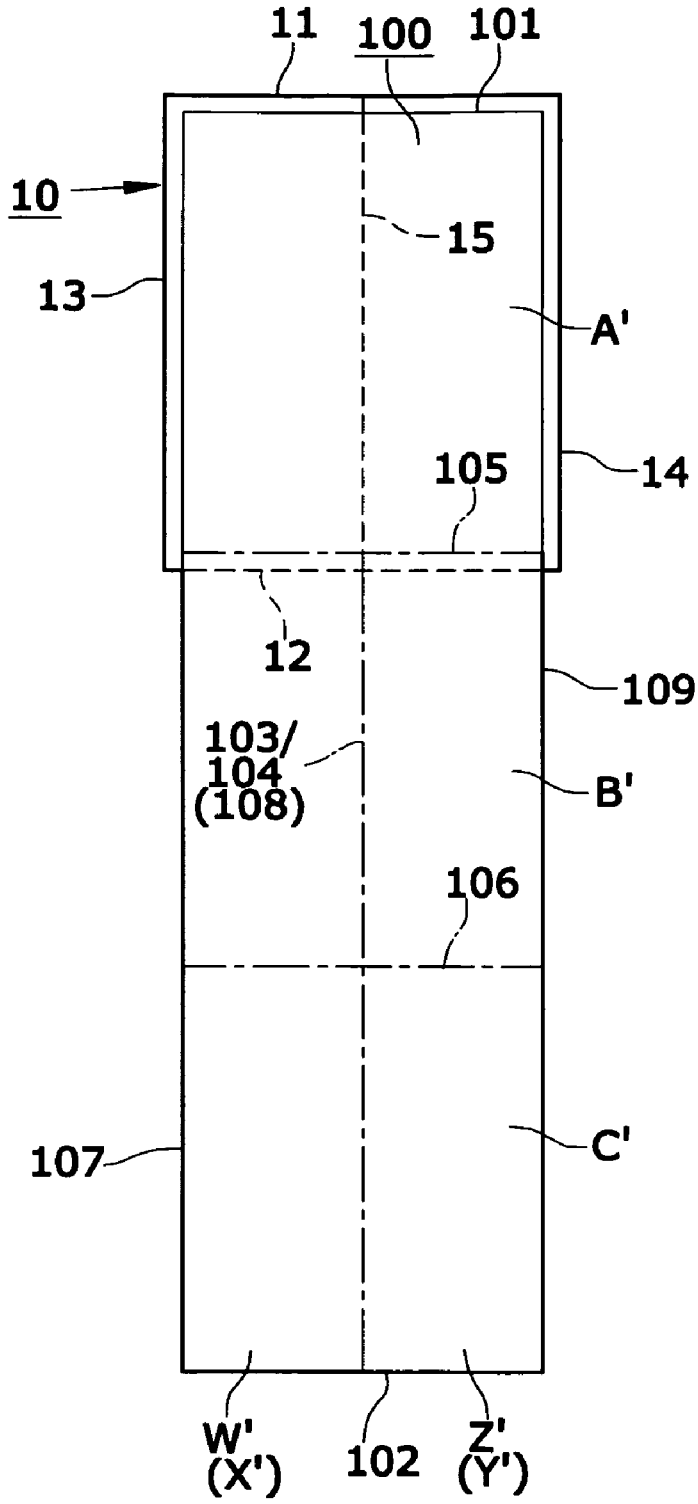
Figure 26:
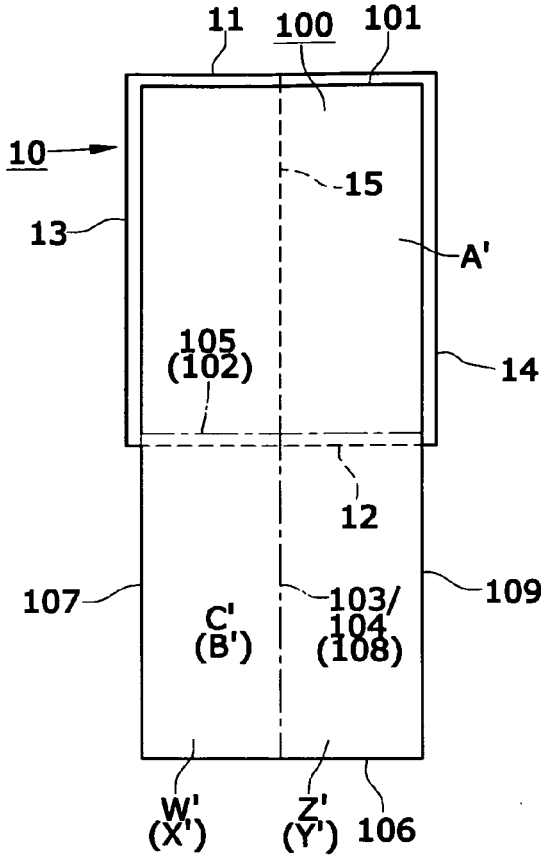
Figure 27:
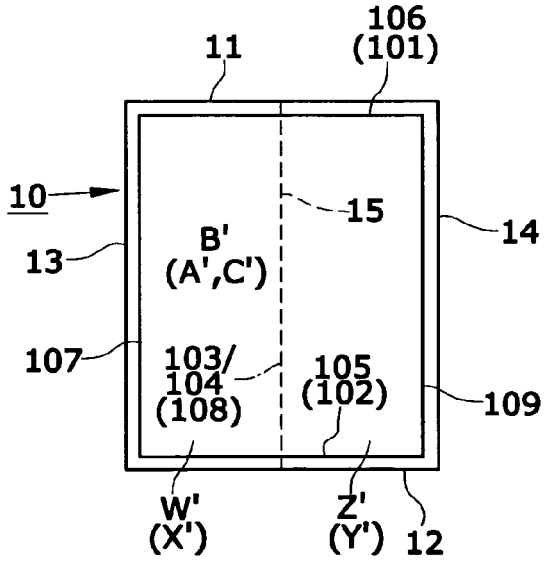

A preferred sequence for folding the booklet 100 shown in FIG. 23 is illustrated in FIGS. 24-27. As shown in FIG. 24, longitudinal panel W' is folded along longitudinal fold line 107 to overlie longitudinal panel X' so that longitudinal fold line 107 becomes the side edge of booklet 100. Longitudinal panel Z' is then folded along longitudinal fold line 109 to overlie longitudinal panel Y' so that longitudinal fold line 109 becomes a side edge of booklet 100 as shown in FIG. 25. Transverse panel C' is then folded along transverse fold line 106 to overlie transverse panel B' so that transverse fold line 106 becomes the bottom edge of booklet 100 as shown in FIG. 26. Transverse panels C'/B' are then folded along transverse fold line 105 which then becomes the bottom edge of booklet 100 as shown in FIG. 27. At this time, booklet cover 10 can be closed by folding it along its transverse fold line 15 so that all of the transverse and longitudinal panels are completely contained within booklet cover 10.

Figure 28:
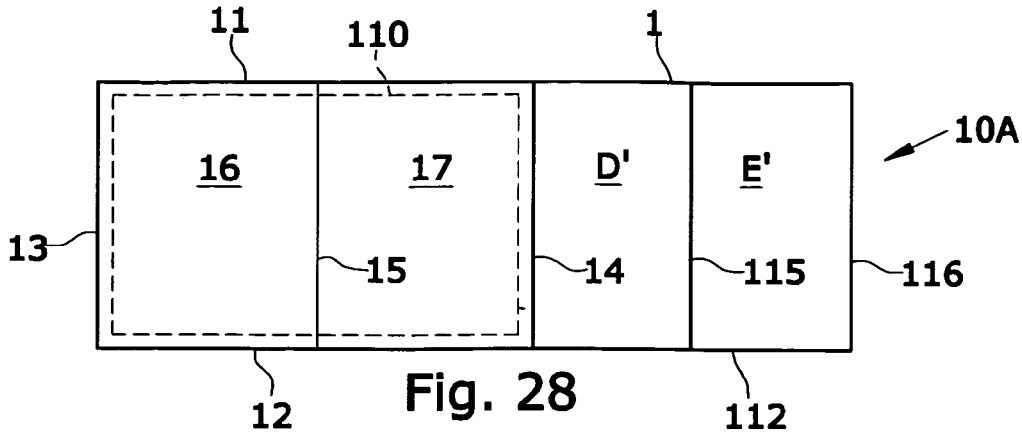
Figure 29:
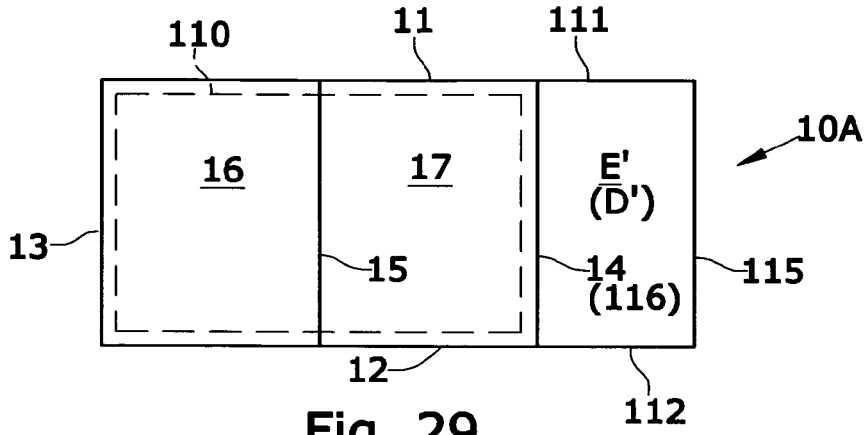
Figure 29A:
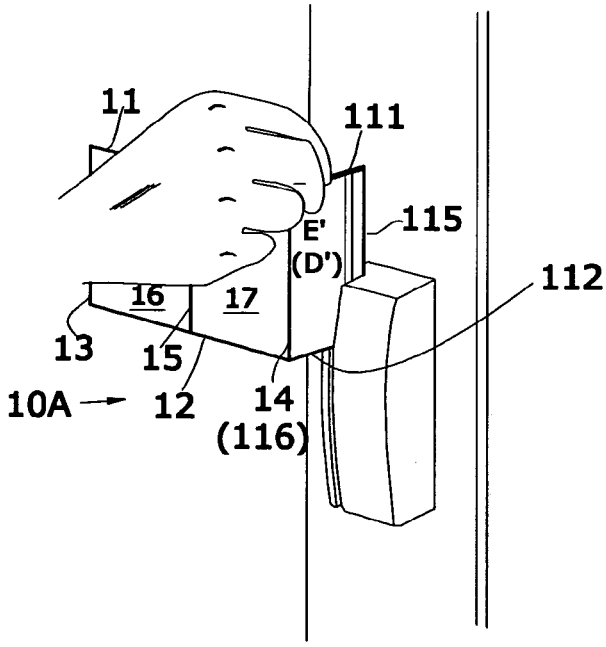
Figure 30:
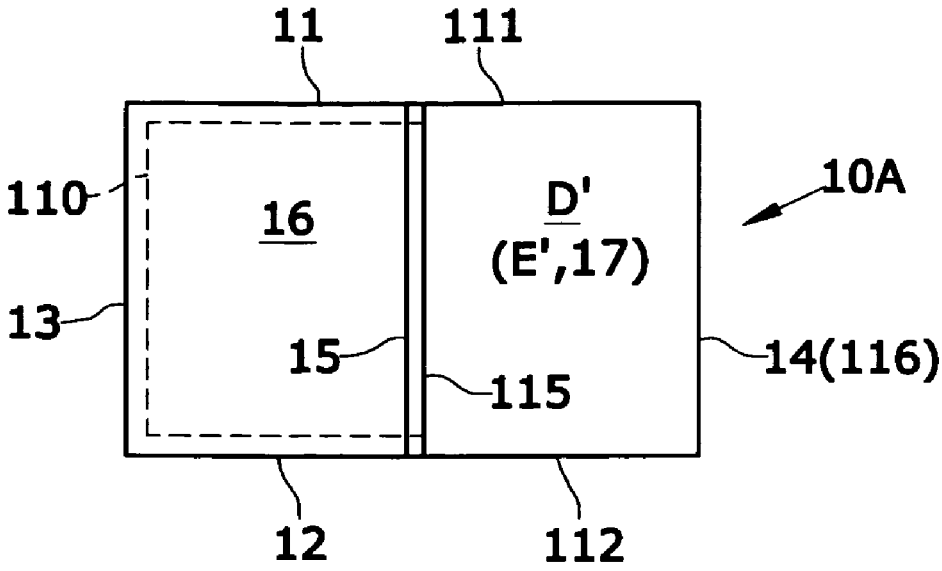

Still a further embodiment of a booklet cover of the invention is illustrated in FIGS. 28-30. In this embodiment, the booklet cover can be the same as or similar to that shown in FIG. 1 and is generally identified in FIGS. 28-30 by reference numeral 10A.

As can be seen, booklet cover 10A has opposed top and bottom edges 11 and 12, respectively, opposed side edges 13 and 14, and a longitudinal fold line 15 intermediate side edges 13 and 14 forming booklet cover panels 16 and 17. Reference numeral 110 identifies booklet pages, shown in phantom, folded within booklet cover 10A.

Attached to a side edge, such as side edge 14, are two side tab extensions D' and E' having common top and bottom edges 111 and 112, respectively, a side edge 116 and a longitudinal fold line 115 intermediate side edge 116 and booklet cover side edge 14. In this embodiment, booklet cover side edge 14 is also a longitudinal fold line. Side tab extensions D' and E' can contain printed matter, indicia, magnetic strips, bar codes, memory chips, and the like, as well as combinations thereof.

To fold the booklet cover 10A shown in FIGS. 28-30, side tab E' is first folded along longitudinal fold line 115 so that side tab E' overlays side tab D', longitudinal fold line 115 becomes the side edge of folded side tabs D' and E' and side edge 116 of side tab E' overlies side edge/longitudinal fold line 14 (FIG. 29).

The thicknesses of side tabs D' and E' are preferably such that when one side tab is folded to overlay the other side tab as shown in FIG. 29, their combined thicknesses is about the same as or equal to that of a credit card or a hotel magnetic door key; i.e., about 30 points thick.

Next, side tab E' overlying side tab D' is then folded along side edge/longitudinal fold line 14 so that side tab D' overlays side tab E' and booklet cover panel 17 as shown in FIG. 30. At this point, side edge/longitudinal fold line 14 is common with the side edge 116 of side tab E' and the top and bottom edges 111 and 112, respectively, and side tabs D' and E' are concurrent with the top and bottom edges 11 and 12, respectively, of booklet cover 10A.

To facilitate the final folding of booklet cover 10A on longitudinal fold line 15, the widths of side tabs D' and E' are slightly less tan the width of booklet panel 17 so that longitudinal fold line 115 (now the side edge of the folded side tabs D' and E') is spaced inwardly from longitudinal fold line 15 of booklet cover 10A when side tabs D' and E' are folded to overlay booklet panel 17 as shown in FIG. 30.

The booklet and booklet pages of the invention can typically be provided from commercially available paper stock and can be secured to either or both of the panels of the booklet covers of the invention as desired by any conventional means such as by using commercially available glues and adhesives. When the booklet of the invention comprises a plurality of booklet pages, they can be bound together to form a booklet spine using conventional techniques such as glues and adhesives.

Throughout all of the embodiments of the invention, it should be appreciated that the booklet, whether comprising a single page or a plurality of pages, was folded along the transverse and longitudinal fold lines without using any accordion or concertina type folds. Thus, when the folded booklet is unfolded regardless of whether it consists of a single page or a plurality of pages, it will lie flat and not have a tendency to spring back to its folded condition as it does not contain any accordion or concertina folds.

The booklet can also be unfolded to display only selected portions of the booklet. For example, the booklet can be unfolded to the condition shown in FIG. 26 to display only that matter contained on transverse panel A', or it can be unfolded to the condition shown in FIG. 25 to display only that matter contained on transverse panels A', B' and C', or it can be unfolded to the condition shown in FIG. 24 to access the matter contained on longitudinal panels Y' and Z', and so forth.

Although the invention has been described with particularity and in some detail, it will be appreciated by those skilled in this art that changes and modifications can be made therein without departing from the scope and spirit of the invention.

What is claimed is:

1. An information-encoded extension includable in a booklet comprising:

a booklet cover comprising opposed top and bottom edges, opposed side edges, and a longitudinal fold line formed between intermediate opposed side edges defining a panel on each side of said longitudinal fold line; and a folding booklet secured to a panel of said booklet cover, said booklet comprising opposed top and bottom edges, a plurality of spaced apart longitudinal fold lines formed therein intermediate said booklet side edges defining a plurality of longitudinal panels, one of said longitudinal fold lines being coincidental to and co-extensive with said booklet cover longitudinal fold line; and a plurality of spaced apart transverse fold lines formed therein intermediate said booklet top and bottom edges defining a plurality of transverse panels, an uppermost of said transverse panels overlying at least one of said booklet cover panels such that said longitudinal panels can be folded along said longitudinal fold lines to overlay one another and said transverse panels can be folded along said transverse fold lines to overlay one another enabling said booklet cover to be folded along its longitudinal fold line and be closed with said folded and overlying longitudinal panels and said folded and overlying transverse panels completely contained within said booklet cover, wherein the folding booklet comprises information printed or otherwise fixed thereon; and a tab extension secured to a side edge of said booklet cover, said tab extension removably secured to said side edge, and wherein the tab extension comprises a magnetic strip thereon encoded with information as either a hotel door lock code or a credit card account number.

2. The information-encoded extension of claim 1, wherein the fold line of said booklet cover is transversely disposed therein intermediate the top and bottom edges of said booklet cover defining a panel on each side of said transverse fold line.

3. The information-encoded extension of claim 1, wherein two foldable tab extensions are secured to a side edge of said booklet cover, said foldable tab extensions comprising a longitudinal fold line intermediate a side edge of said tab extensions and a side edge of said booklet cover.

4. The information-encoded extension of claim 3, wherein the combined thicknesses of said tab extensions when folded to overlay one another is about equal to the thickness of a credit card.

5. The information-encoded extension of claim 1, wherein said booklet comprises a plurality of pages bound together at a booklet spine, said booklet spine being secured to said booklet cover intermediate the side edges of said booklet cover.

6. The information-encoded extension of claim 5, wherein said booklet spine is secured to said booklet cover adjacent to and inboard of one side edge of said booklet cover.

7. The information-encoded extension of claim 5, wherein said booklet spine is secured to said booklet cover so that said spine is coincidental with said fold line of said booklet cover.

8. The information-encoded extension of claim 1, wherein said booklet comprises a plurality of gates secured to a side edge of said booklet.

9. The information-encoded extension of claim 1, wherein at least one panel of the booklet cover comprises a pocket.

10. The information-encoded extension of claim 9, wherein the pocket comprises a transparent material.

11. An information-encoded extension includable in a booklet, wherein the extension comprises:

a booklet cover comprising opposed top and bottom edges, opposed side edges, and a longitudinal fold line formed intermediate said opposed side edges defining a panel on each side of said longitudinal fold line; and a folding booklet secured to a panel of said booklet cover, said booklet comprising opposed top and bottom edges, opposed side edges, a plurality of spaced apart longitudinal fold lines formed therein intermediate said booklet side edges defining a plurality of longitudinal panels, one of said longitudinal fold lines being coincidental to co-extensive with said booklet cover longitudinal fold line; and a plurality of spaced apart transverse fold lines formed therein intermediate said booklet top and bottom edges defining a plurality of transverse panels, an upper most of said transverse panels overlying at least one of said booklet cover panels such that said longitudinal panels can be folded along said longitudinal fold lines to overlay one another and said transverse panels can be folded along said transverse fold lines to overlay one another enabling said booklet cover to be folded along its longitudinal fold line and be closed with said folded and overlying longitudinal panels and said folded and overlying transverse panels completely contained with said booklet cover, wherein the folding booklet comprises information printed or otherwise fixed thereon; and a tab extension secured to each of the side edges of said booklet cover, wherein said tab extension comprises a magnetic strip thereon encoded with information as either a hotel door lock code or a credit card account number.

12. An information-encoded extension includable in a booklet comprising:

a booklet cover comprising opposed top and bottom edges, opposed side edges, and a longitudinal fold line formed intermediate said opposed side edges defining a panel on each side of said longitudinal fold line; and a folding booklet secured to a panel of said booklet cover, said booklet comprising opposed top and bottom edges, opposed side edges, a plurality of spaced apart longitudinal fold lines former therein intermediate said booklet side edges defining a plurality of longitudinal panels, one of said longitudinal fold lines being coincidental to and co-extensive with said booklet cover longitudinal fold line; and a plurality of spaced apart transverse fold lines formed therein intermediate said booklet top and bottom edges defining a plurality of transverse panels, an upper most of said transverse panels overlying at least one of said booklet cover panels such that said longitudinal panels can be folded along said longitudinal fold lines to overlay one another and said transverse panels can be folded along said transverse fold lines to overlay one another enabling said booklet cover to be folded along its longitudinal fold line and be closed with said folded and overlying longitudinal panels and said folded and overlying transverse panels completely contained within said booklet cover; wherein a plurality of gates are secured to the side edges of said booklet, wherein the folding booklet comprises information printed or otherwise fixed thereon; and a tab extension secured to each of the side edges of said booklet cover, wherein said tab extension comprises a magnetic strip thereon encoded with information as either a hotel door lock code or a credit card account number.

* * * * *